US009327928B2

(12) United States Patent
Ibrahim et al.

(10) Patent No.: US 9,327,928 B2
(45) Date of Patent: May 3, 2016

(54) MEDIA HANDLING SYSTEMS FOR ALTERING ORIENTATION OF MEDIA

(71) Applicant: Xerox Corporation, Norwalk, CT (US)

(72) Inventors: Mazhar Ibrahim, Giza (EG); Hassan Gomaa, Giza (EG); Atef Abdelaziz, Giza (EG)

(73) Assignee: Xerox Corporation, Norwalk, CT (US)

( * ) Notice: Subject to any disclaimer, the term of this patent is extended or adjusted under 35 U.S.C. 154(b) by 96 days.

(21) Appl. No.: 14/082,227

(22) Filed: Nov. 18, 2013

(65) Prior Publication Data

US 2015/0137444 A1 May 21, 2015

(51) Int. Cl.

| | |
|---|---|
| ***B65H 5/02*** | (2006.01) |
| ***B65H 29/16*** | (2006.01) |
| ***B65H 29/12*** | (2006.01) |

(52) U.S. Cl.

CPC ..... *B65H 5/023* (2013.01); *B65H 5/025* (2013.01); *B65H 29/12* (2013.01); *B65H 29/16* (2013.01); *B65H 2301/34112* (2013.01); *B65H 2401/242* (2013.01); *B65H 2404/261* (2013.01); *B65H 2404/262* (2013.01); *B65H 2404/264* (2013.01); *B65H 2404/2691* (2013.01); *B65H 2511/51* (2013.01); *B65H 2513/10* (2013.01); *B65H 2513/108* (2013.01); *B65H 2513/512* (2013.01); *B65H 2513/514* (2013.01); *B65H 2555/25* (2013.01); *B65H 2555/26* (2013.01); *B65H 2801/27* (2013.01)

(58) Field of Classification Search

CPC ..... B65H 5/021; B65H 5/023; B65H 29/12; B65H 2301/31; B65H 2301/34; B65H 2301/34112; B65H 2513/20; B65H 2513/21; B65H 2513/108

See application file for complete search history.

(56) References Cited

U.S. PATENT DOCUMENTS

| | | | | |
|---|---|---|---|---|
| 3,988,017 | A * | 10/1976 | Kyhl | 271/111 |
| 6,892,872 | B2 * | 5/2005 | Miyashita | 194/302 |
| 7,832,545 | B2 * | 11/2010 | Giffin | B65G 47/31 198/460.1 |
| 2002/0140156 | A1 * | 10/2002 | Wilson et al. | 271/10.07 |

* cited by examiner

*Primary Examiner* — Michael McCullough
(74) *Attorney, Agent, or Firm* — Jones Robb, PLLC

(57) ABSTRACT

The present disclosure discloses a media transition unit for altering orientation and/or direction of travel of media that defines a first edge and a second edge, which is shorter than the first edge. The media transition unit includes a first module having a first sensor and a first conveyor belt, and a second module having a second sensor and a second conveyor belt. The first module receives the media traveling along a first direction perpendicular to the first edge. The received media is detected by the first sensor that prompts the first conveyor belt to transport the media at a first speed in a second direction perpendicular to the second edge. Upon detecting the media adjacent to the second module, the second sensor prompts the second conveyor belt to transport the media at a second speed along the second direction. The second speed exceeds the first speed.

23 Claims, 4 Drawing Sheets

MEDIA HANDLING SYSTEMS FOR ALTERING ORIENTATION OF MEDIA

TECHNICAL FIELD

The presently disclosed subject matter relates to media handling systems and related methods of use and manufacture, and more particularly to a media transition unit for altering the orientation of media.

BACKGROUND

Media outputted from an imaging apparatus, such as a printer, may be subjected to a media processing machine, such as an auto-mailer device, that performs one or more operations on the media. Examples of such operations include, but not limited to, collation, folding, embossment, perforation, staple, binding, mailing, etc. Usually, the media has short edges and long edges, along which it is outputted from the imaging apparatus at high speed and volume.

In one approach, when the output media is fed along the long edge directly to the media processing machine, the machine may get jammed due to high speed and volume of the media. However, when the imaging apparatus is adapted to reduce the speed of output media and match that with the media input speed of the machine, the efficiency of the imaging apparatus and that of the machine is significantly reduced. Moreover, consumables such as toners and ribbons are expended at a higher rate in the imaging apparatus operating at low speeds.

In another approach, the speed of output media is intermediately reduced before feeding it to the media processing machine for altering the orientation of media from a long-edge-first to a short-edge-first. As a result, the efficiency of the media processing machine is significantly reduced due to the reduction in speed of the received media. Moreover, the output media may suffer a skew during re-orientation and block the input path to the media processing machine.

Therefore, there exists a need for a reliable solution that alters the orientation of the media without compromising on the efficiency of the imaging apparatus or the media processing machine.

SUMMARY

The present disclosure discloses a media transition unit for altering orientation and/or direction of travel of media that defines a first edge and a second edge that is shorter than the first edge. In an embodiment, the media transition unit includes a first module and a second module. The first module includes a first sensor and a first conveyor belt. The first module is configured to accept the media traveling along a first direction substantially perpendicular to the first edge. The first sensor upon detecting presence of the media at the first module prompts the first conveyor belt to transport the media at a first speed in a second direction, which is substantially perpendicular to the second edge.

The second module includes a second sensor and a second conveyor belt. The second module is configured to accept the media from the first module. The second sensor upon detecting presence of the media adjacent to the second module prompts the second conveyor belt to transport the media at a second speed along the second direction. The second speed exceeds the first speed.

Other and further aspects and features of the disclosure will be evident from reading the following detailed description of the embodiments, which are intended to illustrate, not limit, the present disclosure.

DETAILED DESCRIPTION

The following detailed description is made with reference to the figures. Exemplary embodiments are described to illustrate the disclosure, not to limit its scope, which is defined by the claims. Those of ordinary skill in the art will recognize a number of equivalent variations in the description that follows.

DEFINITIONS

In various embodiments of the present disclosure, definitions of one or more terms that will be used in the document are described below. The disclosure includes a media feeding device or media feeder that is configured to output "media" or "medium" referring to physical sheets of paper, plastic, cardboard, or other suitable physical substrates that can pass through media paths of the media feeding device. The media may include a number of edges, for example, at least two edges substantially longer than at least one of their respective adjacent edges. Further, the "long edge" of the media refers to longer edge of the media that is output from the media feeding device. Similarly, the "short edge" of the media refers to shorter edge of the media relative to the long edge of the media. For example, for a standard sheet of paper having rectangular shape and dimensions of 8.5 inches by 11 inches, the "long edge" of sheet refers to the edge of the sheet that is 11 inches in length while the "short edge" refers to the edge of the sheet that is 8.5 inches long.

Further the disclosure includes a media processing machine configured to perform operations, such as collation, folding, embossment, perforation, staple, binding, mailing, etc. on the media. The media processing machine may include a variety of existing, related art, or later developed devices that are configured to perform one or more of such operations.

The numerous references in the disclosure to the media feeding device and the media processing machine are intended to cover any and/or all devices capable of performing respective operations on the media relevant to the applicable context, regardless of whether or not the same are specifically provided.

Exemplary Embodiments

Figure 1:
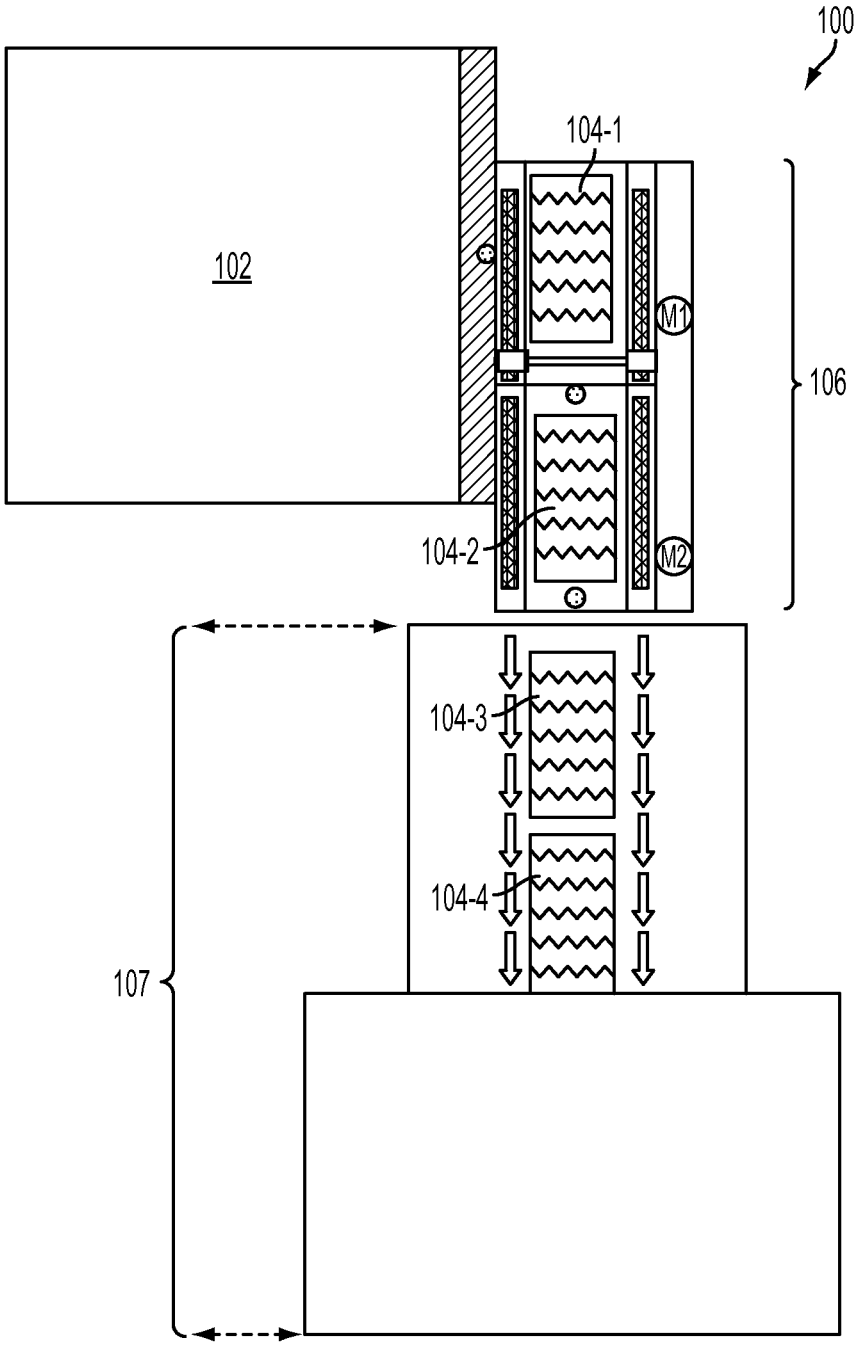
FIG. 1 is a schematic view of an exemplary media handling system, according to an embodiment of the subject matter.

FIG. 1 illustrates a media handling system 100 that allows for high speed processing of media, such as sheets, according to an exemplary embodiment of the subject matter. The media handling system 100 may include a media feeder 102 that is configured to supply or output media, such as media 104-1, 104-2, 104-3, and 104-4 (collectively, media 104), at a predetermined rate and speed via one or more media paths. In one embodiment, the media feeder 102 may be an imaging apparatus, such as a printer, a scanner, a photocopier, an integrated imaging device, or any other suitable device from a variety of existing, related art, or later developed media feeding devices. Various types or designs of media feeder 102 may be deployed based on its functional complexity, size of media 104, and structural compatibility with a device that receives this media 104. In an embodiment, the media feeder 102 may be configured to output the media 104 along a long edge in a first direction. For example, in the case of an 8.5 inch by 11 inch sheet of paper, the media feeder 102 outputs the sheet of paper along its 11 inch side or edge.

The media handling system 100 further includes a media transition unit 106 and a media processing machine 107 in communication with the media transition unit 106. In some embodiments, the media transition unit 106 receives the media 104 along its long edge from the media feeder 102 in a first direction. The media transition unit 106 is configured to deliver the media 104 to the media processing machine 107 along the short edge of the media 104. In other words, the media processing machine 107 receives the media 104 with the leading short edge of the media 104. Thus, in the case of an 8.5 by 11 sheet of paper, the media processing machine 107 receives the sheet in a manner so that an 8.5 inch side or edge is first received.

As shown in FIG. 1, the media transition unit 106 is located adjacent to the media feeder 102 to receive the media 104 from the media feeder 102 in a first direction. As discussed above, the media transition unit 106 receives the media 104 with the leading long edge in the first direction. The media transition unit 106 then conveys the received media 104 in a second direction perpendicular to the first direction from which the media 104 was outputted from the media feeder 102. In other words, the media 104 are moved in a direction such that its short edge is now its leading edge. Further, the media 104 are conveyed towards a media transition unit 106, which is configured to receive the media 104 and deliver it to the processing machine 107. In some embodiments, as described earlier, the media 104 is delivered to the processing machine 107 with the short edge as the leading edge because the processing machine 107 is a type of system that works efficiently when the media 104 is delivered in such an orientation. For example, the processing machine 107 may be an automatic mailer that operates more efficiently when the media 104 is delivered with the short edge as the leading edge. The automatic mailer may be configured to automatically scan and email the received media 104. The media processing machine 107 may be located to receive the media 104 along the short edge from the media transition unit 106.

The operating speed of a section of the media transition unit 106 that receives the media 104 may be adjusted to be substantially equivalent to or in accordance with the operating speed of the media feeder 102 at which the media feeder 102 outputs the media 104 in the first direction. Such adjustment to the operating speed allows the media transition unit 106 to continuously receive and transport the media 104 in the second direction without jamming a media path of the media transition unit 106.

Figure 2:
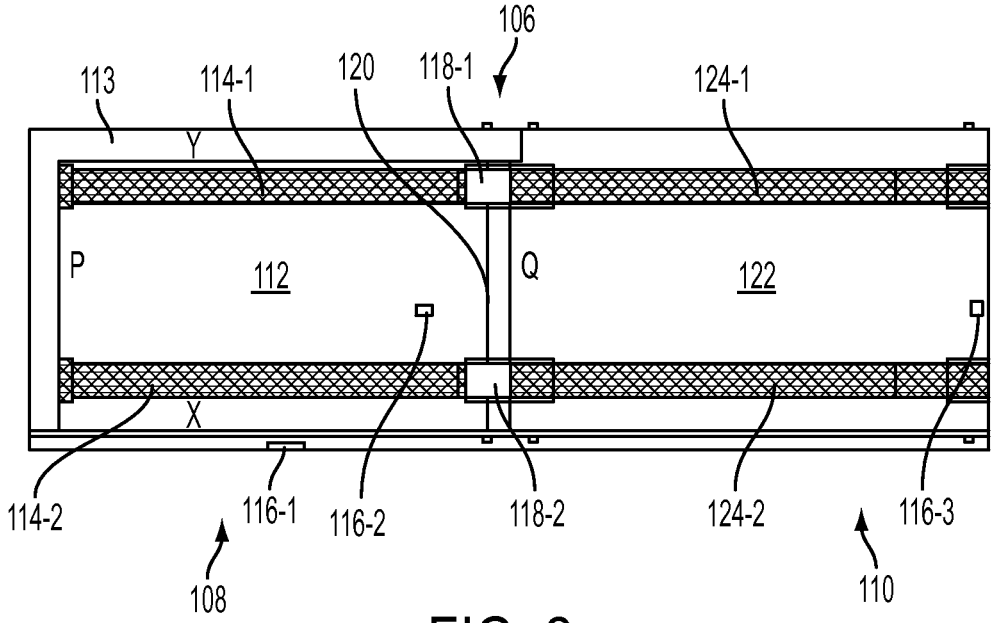
FIG. 2 is a top view of an exemplary media transition unit, according to an embodiment of the subject matter.

FIG. 2 is a top view of an exemplary media transition unit, according to an embodiment of the subject matter. As described above, the media transition unit 106 receives the media 104 in the first direction whereby the long edge is the leading edge received by the media transition unit 106. As shown in FIG. 2, the media transition unit 106 includes a first module 108 and a second module 110 for receiving the media 104 in a first direction and conveying the media 104 in a second direction that is perpendicular to the first direction. The first module 108 may be manufactured in the form of a tray 112 including a first longitudinal edge X, and an opposing second longitudinal edge Y. Between the longitudinal edges X, Y, the tray 112 includes a first transverse edge P and an opposing second transverse edge Q. The first longitudinal edge X of the tray 112 is adjacent a media output section of the media feeder 102 so that the first module 108 receives the media 104 from the media feeder 102 in the first direction. Along the second longitudinal edge Y and the first transverse edge P, the tray 112 includes an L-shaped wall 113 of a predetermined height and that the wall 113 may be made of the same material as that of the tray 112 or any other suitable material known in the art. The wall 113 may register the received media 104 in a predetermined position for translating the media 104 in a predetermined orientation for transfer.

The tray 112 further includes conveyor belts 114-1, 114-2 (collectively, conveyor belts 114) for transporting the received media 104 in the second direction perpendicular to the first direction of travel of the media 104 from the media feeder 102. The tray 112 may additionally include one or more sensors 116-1, 116-2 (sensors 116) for detecting the presence of the media 104 in close proximity. The conveyor belts 114 may be made of plastics, rubber, or any other suitable existing, related art, or later developed material. The conveyor belts 114 may be configured to provide a first media path for the received media 104. The conveyor belts 114 include a predetermined transverse separation between them. This separation extends along the entire length of the conveyor belts 114. However, the belts 114 are configured to substantially receive the media 104 from the media feeder 102. The conveyor belts 114-1 and 114-2 may extend along the longitudinal edges X, Y, respectively.

Further, over the conveyor belts 114, foam rollers 118-1 and 118-2 (collectively, foam rollers 118) may be mounted on a shaft 120, which runs transverse to the longitudinal axis of the first module 108. The shaft 120 is also located adjacent to the second transverse edge Q of the tray 112. There may be a predetermined spacing between the foam rollers 118 and the conveyor belts 114 to provide a passage for the received media 104. One of skill in the art will understand that the foam rollers 118 may be made of any existing, related art, or later developed suitable material, which is porous, and/or soft in nature.

The first sensor 116-1 may be located adjacent to the first longitudinal edge X and the second sensor 116-2 may be placed adjacent to the second transverse edge Q of the tray 112. The sensor 116-1 may be configured to operate control circuits (FIG. 5) that drive the first module 108 in tandem with the media feeder 102. Similarly, the sensor 116-2 may be configured to operate control circuits (FIG. 5) that drive the second module 110 in tandem with the first module 108. Different types of existing, related art, or later developed sensors 116 may be employed for detecting the media 104. In an embodiment, the sensors 116 may be photo cells of infrared type configured to emit light continuously, or may be any electromechanical or electronic device configured to detect the media 104 present within its detection or operational range. It should be understood that the sensors 116-1, 116-2 can be disposed adjacent to any portion of the first module 108 provided the sensors 116-1, 116-2 are capable of detecting the media 104 before being received by the first module 108 and by the second module 110, respectively.

The first module 108 may be in communication with the second module 110, along the transverse edge Q of the tray 112. The second module 110 may include a top tray 122 and a bottom tray (not shown) having a predetermined spacing between them. Both the top tray 122 and the bottom tray may include respective conveyor belts. For example, as shown, the top tray 122 may include conveyor belts 124-1 and 124-2 (collectively, conveyor belts 124) that are longitudinally parallel to the conveyor belts 114. Similarly, the bottom tray also includes conveyor belts (FIG. 3), which are disposed along the longitudinal axis of the conveyor belts 114. The conveyor belts on the bottom tray provide a second media path on the second module 110 and assist in guiding and registering the media 104. Similar to the first module 108, the second module 110 may include a third sensor 116-3, which is similar to the sensors 116-1, 116-2, for detecting the media 104 exiting from the second module 110. The sensor 116-3 may be located on the top tray 122 and adjacent to a transverse edge of the second module 110 away from the first module 108.

Figure 3:
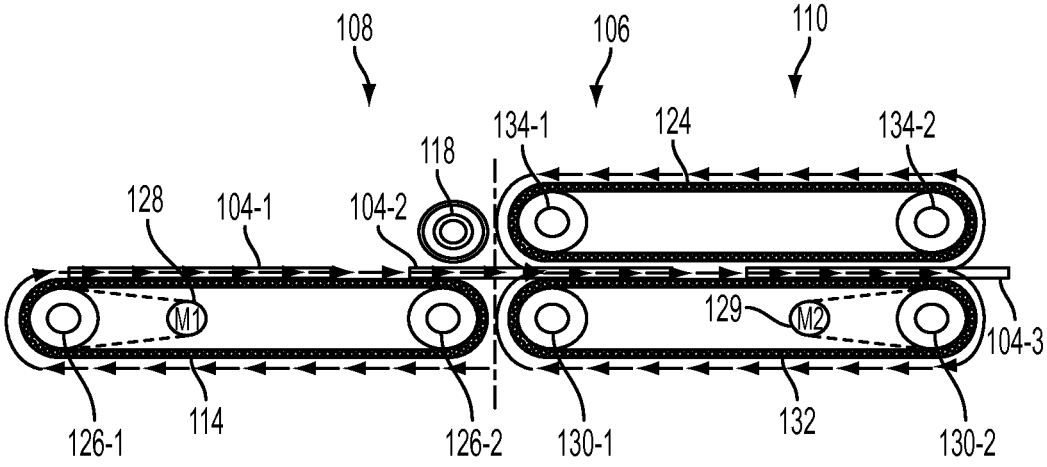
FIG. 3 is a partial, schematic side view of exemplary modules of the media transition unit of FIG. 2, according to an embodiment of the subject matter.

FIG. 3 is a partial, schematic side view of the media transition unit of FIG. 2, according to an embodiment of the subject matter. The first media path of the first module 108 may be in communication with the second media path of the second module 110. The first module 108 may further include a first set of pulleys 126-1 and 126-2 (collectively, first set of pulleys 126), which may include respective conjugate pulleys (not shown) coupled to each other via at least one respective shaft (not shown). The first set of pulleys 126 may be located below the first tray 112 for driving the respective conveyor belts 114. The pulley 126-1 may be driven by a motor M1 and in turn rotates the remaining first set of pulleys 126 in a clockwise (or anti-clockwise) direction to drive the conveyor belts 114 towards the second module 110. In an embodiment, the driving motor M1 is a DC motor 128, which directly couples the applied power supply to the field of the DC motor 128 to adjust the speed and torque generated in the DC motor 128 corresponding to the speed of the media feeder 102.

Figure 5:
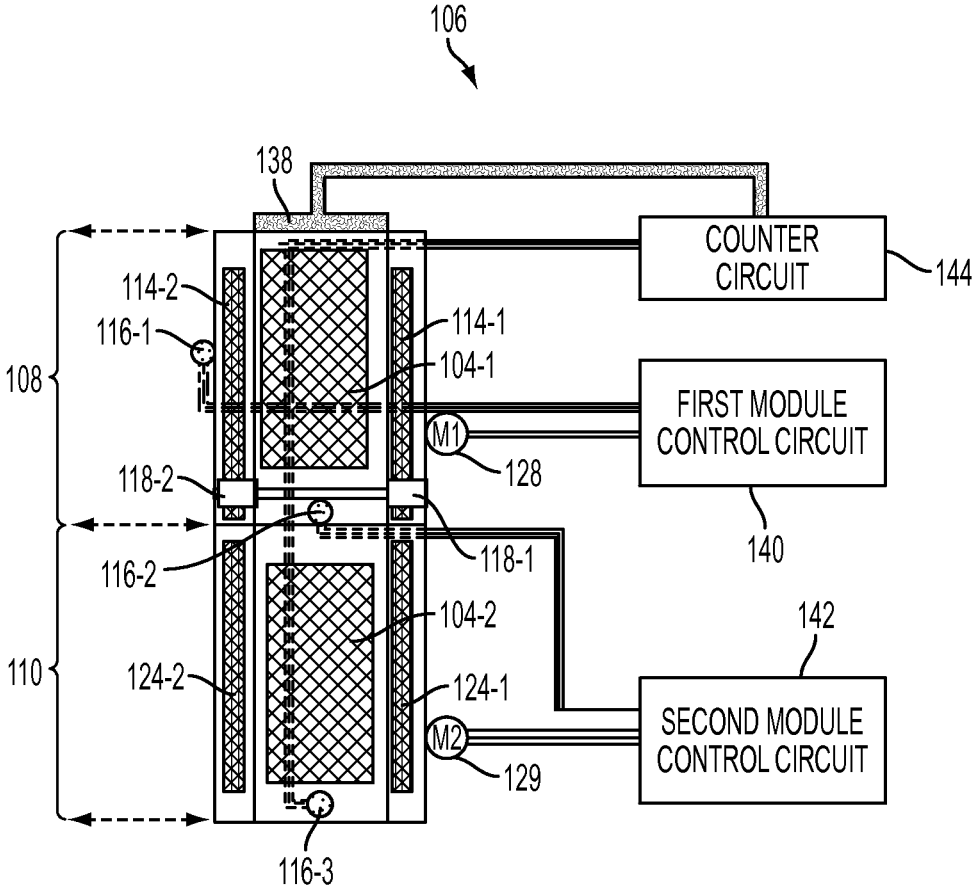
FIG. 5 is a schematic view illustrating exemplary operation of the media transition unit of FIG. 2.

The second module 110 includes a second set of pulleys 130-1 and 130-2 (collectively, second set of pulleys 130), which may include respective conjugate pulleys (not shown) coupled to the second pulley set 130 via at least one respective shaft (not shown). The second set of pulleys 130 is located below the bottom tray of the second module 110 for driving the respective conveyor belts, such as, conveyor belts 132. Similarly, the second module 110 includes a third set of pulleys 134-1 and 134-2 (collectively, third set of pulleys 134), which may include respective conjugate pulleys (not shown) coupled to the third set of pulleys 134 via at least one respective shaft (not shown). These third set of pulleys 134 along with their conjugate pulleys are located below the top tray 122 of the second module 110 for driving the respective conveyor belts 124. The pulley 130-2 may be driven by a motor M2 that in turn, may rotate the second set of pulleys 130 in a clockwise (or anti-clockwise) direction to drive the conveyor belts 132 on the bottom tray towards the media processing machine 107. In an embodiment, the driving motor M2 is a stepper motor 129, which is configured to provide more initial speed at its start-up and stop. This enables the second module 110, particularly the conveyor belts 132 to pick the media 104 away from the first module 108 at a faster speed relative to the operating speed of the first module 108 and deliver the picked media 104 towards the media processing machine 107. Also, the stepper motor 129 allows accelerating the media 104 on the second module 110, since the stepper motor 129 exhibits high torque at small angular velocities relative to that in the DC motor 128. Thus, the media transport speed on the second module 110 is greater than the media transport speed on the first module 108. Further, the operating speeds of the motors 128 and 129 may be adjusted independent of each other via respective control circuits (FIG. 5). The operating speed of the conveyor belts 114 on the first module 106 is greater than the operating speed of the conveyor belts 124, 132 on the second module 110. This allows the media transport speeds on the first module 108 and the second module 110 to move out the media 104 at greater speeds from the media transition unit 106 without jamming the media path, while feeding the media 104 into the media processing machine 107 at a predetermined rate.

Figure 4:
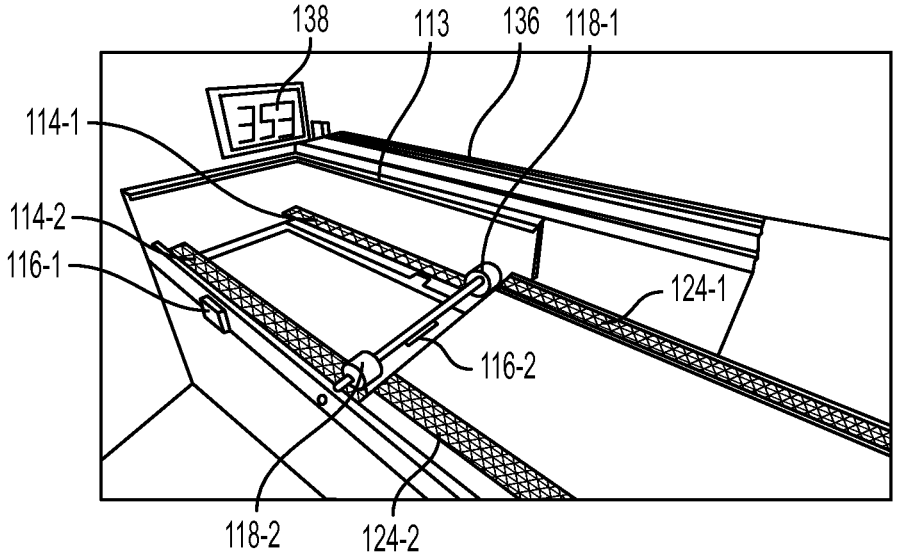
FIG. 4 is a partial, perspective view of the media transition unit of FIG. 2 according to an embodiment of the subject matter.

FIG. 4 is a partial, perspective view of the media transition unit of FIG. 2, according to an embodiment of the subject matter. The media transition unit 106 may further include a support 136 on which the first module 108, the second module 110, and the wall 113 may be mounted. Such mounting allows aligning of the media feeder 102, the media processing machine 107, the first module 108, and the second module 110 in the same horizontal plane and in flow communication with each other. The support 136 may be made of a variety of existing, related art, or later developed materials, which are rigid, including metals, alloys, and polymers.

The media transition unit 106 may optionally include a display unit 138 configured to display the count of media 104 exiting the second module 110 of the media transition unit 106. A variety of existing, related art, or later developed display units may be used for this purpose, for example a hexadecimal display unit known in the art. This display unit 138 along with a display control circuit (not shown), a counter circuit (FIG. 5), the first module 108 and the second module 110, may be mounted over the support 136. In some embodiments, the display control circuit may be integrated with the counter circuit.

FIG. 5 is a schematic view that illustrates exemplary operation of the media transition unit of FIG. 2. The media transition unit 106 may include a first module control circuit 140 and a second module control circuit 142. The first module control circuit 136 may be coupled to the first sensor 116-1 and the DC motor 128 of the first module 108. The second module control circuit 142 may be coupled to the second sensor 116-2 and the stepper motor 129 of the second module 110. The media transition unit 106 may optionally include a counter circuit 144, which is coupled to the third sensor 116-3 and the display unit 138.

During operation, the media feeder 102, such as an imaging apparatus, may be arranged to output the media 104 in a first direction whereby the long edge of the media 104 is the leading edge. In other words, the first direction in which the media is outputted by the media feeder 102 is substantially perpendicular to the long edge of the media 104. In the first direction, as the media 104 passes over the first sensor 116-1 for translation on to the media transition unit 106, the media 104 may be detected by the sensor 116-1 to activate the first module control circuit 140. The first sensor 116-1 enables the first module control circuit 140 to start or stop automatically within a first predetermined time based on the media 104 to be delivered from the media feeder 102 on to the first module 108. Upon activation, the first module control circuit 140 provides pulse-width modulation signals having a first duty cycle for controlling the power supply applied to the DC motor 128. The first module control circuit 140 initiates the DC motor 128 for the first predetermined time. The first module control circuit 140 may additionally adjust the speed of operation of the DC motor 128 based on the operating speed of the media feeder 102 so that the media 104 is received by the first module 108 without jamming the associated media path. Subsequently, the received media 104 along the long edge is registered against the wall 113 and placed over the conveyor belts 114, which are then driven by the DC motor 128. The conveyor belts 114 drive the media 104 at a first speed in a second direction that is substantially perpendicular to the first direction, i.e., the second direction is substantially perpendicular to the short edge of the media 104, towards the second module 110.

While being driven in the second direction, the media 104 is detected by the second sensor 116-2 to activate the second module control circuit 138 as the media 104 is about to enter the second module 110. The second module control circuit 138 generates pulse-width modulation signals having a second duty cycle, which is relatively lesser than the first duty cycle, to trigger the stepper motor 129 for a second predetermined time. The second module control circuit 142 may additionally adjust the speed of operation of the stepper motor 129 in accordance with the operating speed of the first module 108 for smooth operation of the media transition unit 106. Upon activation, the stepper motor 129 drives the conveyor belts 132 on the bottom tray of the second module 110 at a second speed, which is greater than the first speed. This allows the media 104 to quickly move out of the media transition unit 106 without jamming while feeding the media 104 into the processing machine 107 at a predetermined rate. The stepper motor 129 operates simultaneously with the DC motor 128 to pick-up the media 104 from the first module 108 to the second module 110. The picked-up media 104 moves in the spacing between the conveyor belts 132 and 124 on the second module 110. The conveyor belts 132 and 124 press the media 104 to smoothen any media buckling and avoid jamming of the media 104. For this, the conveyor belts 132 and 124 may rotate counter clockwise relative to each other for driving the media 104 towards the media processing machine 107. For example, if the conveyor belts 132 are rotated in a clockwise direction by the motor 129, the conveyor belts 124 correspondingly rotate in an anti-clockwise direction as the media 104 travels between the belts 132, 124.

The media 104 driven towards the media processing machine 107 is detected by the third sensor 116-3, which in turn activates the counter circuit 144. The counter circuit 144 may be configured to count the media 104 exiting from the media transition unit 106. The counter circuit 144 may determine the media count and output the media count on the display unit 140. The media 104 may then be driven towards the media processing unit 107 through the third sensor 116-3. Once the media 104 is transferred to the media processing machine 107, the first module control circuit 140 automatically stops the DC motor 128 using the pulse-width modulation signals having first duty cycle after the first predetermined time. Alongside, the second module control circuit 142 automatically stops the stepper motor 129 using the pulse-width modulation signals having second duty cycle after the second predetermined time. The first predetermined time is greater than the second predetermined time.

Although the media transition unit 106 has been explained with respect to the media feeder 102, it will be well understood by a person skilled in the art that the media transition unit 106 can be incorporated or otherwise used with other imaging apparatuses such as scanners, photocopiers, integrated imaging devices, and facsimile machines.

The above description does not provide specific details of manufacture or design of the various components. Those of skill in the art are familiar with such details, and unless departures from those techniques are set out, techniques, known, related art or later developed designs and materials should be employed. Those in the art are capable of choosing suitable manufacturing and design details.

The terminology used herein is for the purpose of describing particular embodiments only and is not intended to be limiting of the disclosure. It will be appreciated that several of the above-disclosed and other features and functions, or alternatives thereof, may be combined into other systems or applications. Various presently unforeseen or unanticipated alternatives, modifications, variations, or improvements therein may subsequently be made by those skilled in the art without departing from the scope of the subject matter as encompassed by the following claims.

What is claimed is:

1. A media transition unit for altering orientation and/or direction of travel of media that defines a first edge and a second edge that is shorter than the first edge, the media transition unit comprising:

a first module that includes a first sensor, a first conveyor belt driven by a direct current (DC) motor, and a first module control circuit configured to automatically control the DC motor for driving the first conveyor belt based on media-detection signals from the first sensor, the first module being configured to accept the media traveling at a feeder speed onto the first module and along a first direction substantially perpendicular to the first edge, the first sensor upon detecting presence of the media at the first module prompting the first module control circuit to drive the first conveyor belt to transport the media at a first transition speed, which is substantially equivalent to the feeder speed, in a second direction substantially perpendicular to the second edge; and a second module that includes a second sensor, a second conveyor belt driven by a stepper motor having a higher torque at small angular velocities relative to that of the DC motor, and a second module control circuit configured to automatically control the stepper motor for driving the second conveyor belt based on media-detection signals from the second sensor, the second module being configured to accept the media from the first module, the second sensor upon detecting presence of the media adjacent to the second module prompting the second module control circuit to accelerate the media on the second module and to drive the second conveyor belt at a second transition speed along the second direction, the second transition speed exceeding the first transition speed and the substantially equivalent feeder speed, wherein the second module control circuit adjusts the second transition speed based on the first transition speed.

2. The media transition unit of claim 1, wherein the second module further includes a third sensor located opposite to the second sensor, the third sensor configured to detect the presence of the media.

3. The media transition unit of claim 2, further includes a counter circuit configured to count the media on the second module based on media-detection signals from the third sensor.

4. The media transition unit of claim 1, wherein the first module and the second module are aligned in a common horizontal plane.

5. The media transition unit of claim 1, wherein the DC motor and the stepper motor operate simultaneously during transfer of the media from the first module to the second module.

6. The media transition unit of claim 1, wherein the first module control circuit is configured to generate non-transitory pulse-width modulation signals having a first duty cycle for a first predetermined time.

7. The media transition unit of claim 6, wherein the second module control circuit is configured to generate non-transitory pulse-width modulation signals having a second duty cycle for a second predetermined time, which is lesser than the first predetermined time.

8. The media transition unit of claim 1, wherein the first module control circuit is capable of adjusting operating speed of the DC motor based on operating speed of a media feeder configured to supply the media to the first module.

9. A media handling system for use with media that defines a first edge and a second edge that is shorter than the first edge, the media handling system comprising:

a media feeder that outputs the media at a feeder speed along a first direction substantially perpendicular to the first edge;

a media transition unit for altering orientation and/or direction of travel of the media, the media transition unit including:

a first module that includes a first sensor, and a first conveyor belt, belt driven by a direct current (DC) motor, and a first module control circuit configured to automatically control the DC motor for driving the first conveyor belt based on media-detection signals from the first sensor, the first module being configured to accept the media from the media feeder traveling at the feeder speed, the first sensor upon detecting presence of the media at the first module prompting the first module control circuit to drive the first conveyor belt to transport the media at a first transition speed, which is substantially equivalent to the feeder speed, in a second direction that is substantially perpendicular to the second edge; and a second module that includes a second sensor, and a second conveyor belt, belt driven by a stepper motor having a higher torque at small angular velocities relative to that of the DC motor, and a second module control circuit configured to automatically control the stepper motor for driving the second conveyor belt based on media-detection signals from the second sensor, the second module being configured to accept the media from the first module, the second sensor upon detecting presence of the media adjacent to second module prompting the second module control circuit to accelerate the media on the second module and to drive the second conveyor belt at a second transition speed along the second direction, the second transition speed exceeding the first transition speed, wherein the second module control circuit adjusts the second transition speed based on the first transition speed; and a processing machine configured to accept the media from the second module of the media transition unit.

10. The media handling system of claim 9, wherein the media feeder is an imaging apparatus and the processing machine is an automatic mailer.

11. The media handling system of claim 9, wherein the media feeder is configured to output the media at the feeder speed, wherein the feeder speed allows the first module to continuously receive and transport the media in the second direction.

12. The media handling system of claim 9, wherein the media feeder, the media transition unit and the processing machine are located in the same horizontal plane.

13. The media handling system of claim 9, wherein the second module further includes a third sensor located opposite to the second sensor, the third sensor configured to detect the presence of the media.

14. The media handling system of claim 13, further includes a counter circuit configured to count the media on the second module based on media-detection signals from the third sensor.

15. The media handling system of claim 9, wherein the first module and the second module are aligned in the same horizontal plane.

16. The media handling system of claim 9, wherein the DC motor and the stepper motor operate simultaneously during transfer of the media from the first module to the second module.

17. The media handling system of claim 9, wherein the first module control circuit is configured to generate non-transitory pulse-width modulation signals having a first duty cycle for a first predetermined time.

18. The media handling system of claim 17, wherein the second module control circuit is configured to generate non-transitory pulse-width modulation signals having a second duty cycle for a second predetermined time, which is lesser than the first predetermined time.

19. The media handling system of claim 9, wherein the first module control circuit is capable of adjusting operating speed of the DC motor based on operating speed of the media feeder.

20. A method for altering orientation and/or direction of travel of media that defines a first edge and a second edge that is shorter than the first edge, the method comprising:

detecting acceptance by a first module of the media traveling at a feeder speed onto the first module and along a first direction substantially perpendicular to the first edge;

transporting the media at a first transition speed, which is substantially equivalent to the feeder speed, in a second direction substantially perpendicular to the second edge upon detecting acceptance of the media by the first module;

detecting the media transported at the first transition speed in the second direction adjacent to a second module;

transporting the media at a second transition speed in the second direction upon detecting the media transported at the first transition speed in the second direction by the second module, the second transition speed exceeds the first transition speed and the substantially equivalent feeder speed; and adjusting the second transition speed based on the first transition speed.

21. The method of claim 20 further comprising:

detecting the media transported at the second transition speed in the second direction on the second module;

performing a count of the media detected on the second module; and displaying the count of medium.

22. A media transition unit for altering orientation and/or direction of travel of media that defines a first edge and a second edge that is shorter than the first edge, the media transition unit comprising:

first and second modules;

means for detecting acceptance by a first module of the media traveling at a feeder speed onto the first module and along a first direction substantially perpendicular to the first edge;

means for transporting the media at a first transition speed, which is substantially equivalent to the feeder speed, in a second direction substantially perpendicular to the second edge upon detecting acceptance of the media by the first module;

means for detecting the media transported at the first speed in the second direction adjacent to a second module;

means for transporting the media at a second transition speed in the second direction upon detecting the media transported at the first speed in the second direction by the second module, the second transition speed exceeds the first transition speed and the substantially equivalent feeder speed; and means for adjusting the second transition speed based on the first transition speed.

23. The media transition unit of claim 22 further comprising:

means for detecting the media transported at the second transition speed in the second direction on the second module;

means for performing a count of the media detected on the second module; and means for displaying the count of medium.

* * * * *